United States Patent [19]

Mitani

[11] 4,347,729

[45] Sep. 7, 1982

[54] HAND RIVETER

[76] Inventor: Kiyoshi Mitani, No. 3-1-13, Minamikosakai-cho, Yao-shi, Osaka-fu, Japan

[21] Appl. No.: 210,243

[22] Filed: Nov. 25, 1980

[30] Foreign Application Priority Data

Jul. 17, 1980 [JP] Japan ..... 55-101632[U]

[51] Int. Cl.[3] ..... B21J 15/34

[52] U.S. Cl. ..... 72/391

[58] Field of Search ..... 72/391, 114, 454, 409; 29/243.5, 243.53

[56] References Cited

U.S. PATENT DOCUMENTS

| | | | |
|---|---|---|---|
| 3,842,649 | 10/1974 | DiMaio | 72/391 |
| 4,136,547 | 1/1979 | Ewig | 72/391 |
| 4,147,047 | 4/1979 | Fluester | 72/391 |

*Primary Examiner*—Gene Crosby

*Attorney, Agent, or Firm*—Larson and Taylor

[57] ABSTRACT

A hand riveter consisting essentially of a frame main body, a lever, a jaw case support member, a jaw case accommodating a jaw assembly, and a jaw case housing. The jaw assembly attached to the head portion of the riveter is easily shiftable to a forward position or a downward position as desired through an angle of displacement of about 90 degrees.

7 Claims, 8 Drawing Figures

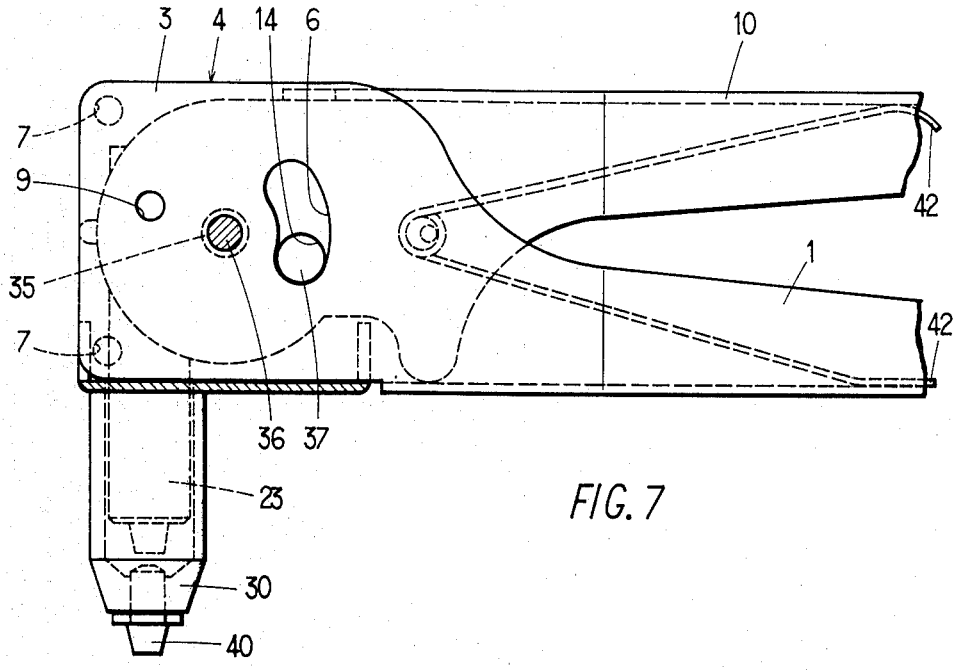
FIG. 7
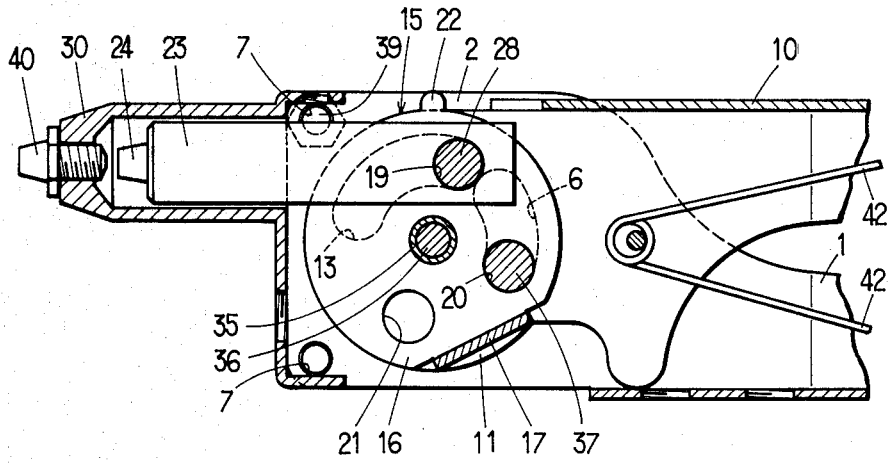
FIG. 8
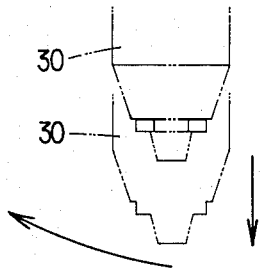

HAND RIVETER

BACKGROUND OF THE INVENTION

Conventional hand riveters are fixedly provided with a jaw assembly in a forward position or a downward position only.

Accordingly when rivets are not settable with a forward-type riveter or downward-type riveter owing to the shape of the work or other conditions, a riveter of the other different type must alternatively be used. This inconvenience leads to a serious reduction in rivet setting efficiency.

SUMMARY OF THE INVENTION

The present invention relates to improvements in hand riveters, and more particularly to a hand riveter having a jaw assembly attached to its head portion and easily shiftable to a forward position or to a downward position as desired through an angle of displacement of about 90 degrees.

An object of this invention is to provide a hand riveter including a jaw assembly which is readily shiftable either to a forward position or to a downward position as desired in accordance with the configuration of the work to be riveted and with other conditions and which therefore assures rivet setting with a greatly improved efficiency.

Another object of the invention is to provide a hand riveter which singly is serviceable both as a forward-type riveter and as a downward-type riveter although at least two kinds of such riveters are conventionally needed for rivet setting since the jaw assembly is usually fixedly attached to the riveter main body in a forward position or a downward position only, the hand riveter of this invention thus being made available economically.

The hand riveter of this invention comprises a frame main body having a head opened at least at its upper, lower and front portions to provide opposite side walls, a lever turnably supported by a pivot on the side walls, a jaw case support member turnably mounted on the pivot and having a jaw case pivotably supported thereon, and a jaw case housing supported by the pivot upwardly and downwardly turnably. The frame main body is formed in at least one of the side walls with an opening positioned around the pivot for passing therethrough a pin for locking the jaw case support member in an adjustable position. The lever is formed around the pivot with a slot for permitting turn of the jaw case support member and with a hole for passing the locking pin therethrough. The jaw case support member is formed with locking pin bores arranged around the pivot at least at two locations angularly displaced from each other about the pivot approximately by 90 degrees. The jaw case support member is turnably attached to the lever by a jaw case support pin inserted through the slot. The locking pin is removably inserted through the opening in the frame main body, through the hole in the lever and through either one of the bores in the jaw case support member. The jaw case housing has the jaw case therein and is attached to the frame head fixedly but angularly shiftably to a vertical position or to a horizontal position.

With the hand riveter of this invention having the foregoing construction, the jaw assembly is readily shiftable to the forward position or to the downward position as desired, by withdrawing the locking pin, turning the support member along with the jaw case and the jaw case housing toward the desired direction to register the other locking pin bore of the support member with the hole of the lever and with the opening of the frame main body, inserting the locking pin through these bore, hole and opening, and fixing the housing in position. Accordingly the riveter has the distinct advantage that rivets are settable in an optimum state in accordance with the shape of the work to be riveted and with other conditions. The riveter therefore assures a greatly improved riveting efficiency and great economy in that it is serviceable as the two types of riveters if used singly.

BRIEF DESCRIPTION OF THE DRAWINGS

FIG. 7 is a view in section taken along the line D—D in FIG. 3; and

FIG. 8 is a fragmentary front view in section showing the embodiment with a jaw case housing turned to its horizontal position.

DESCRIPTION OF THE PREFERRED EMBODIMENT

Figure 1:
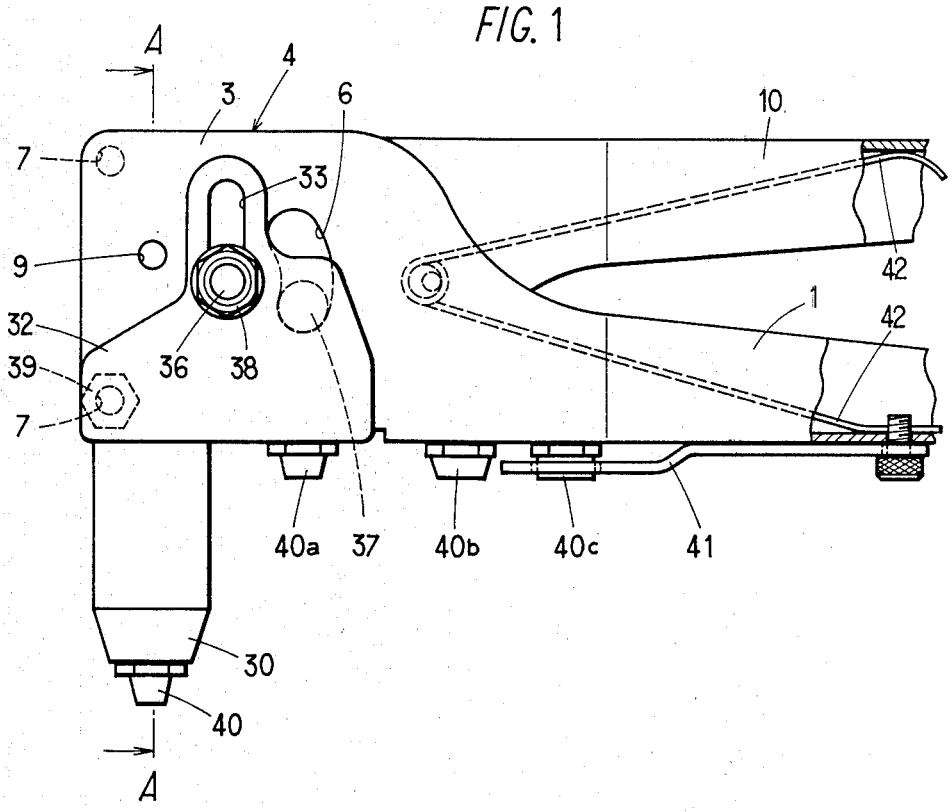
FIG. 1 is a fragmentary front view showing an embodiment of this invention.
Figure 2:
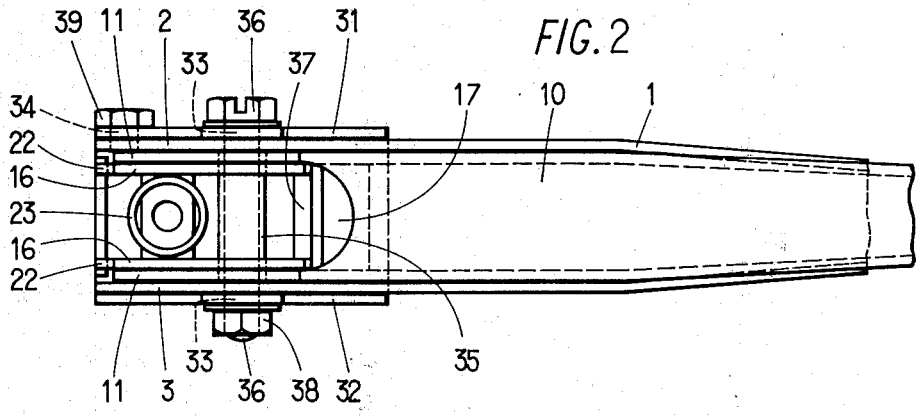
FIG. 2 is a plan view of the same.
Figure 3:
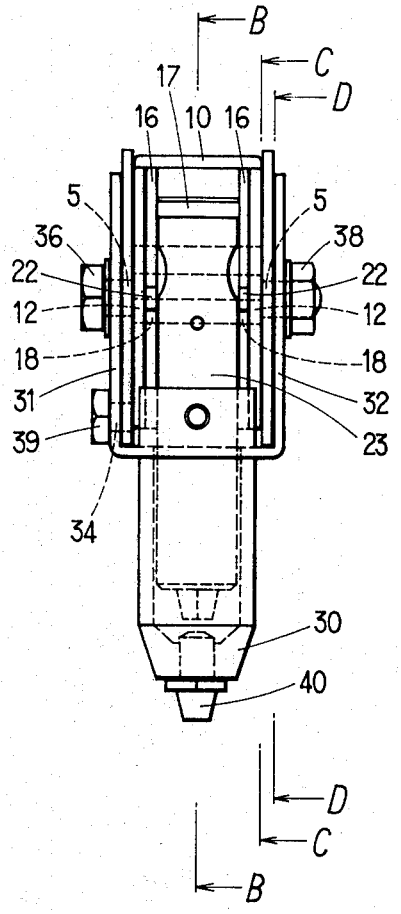
FIG. 3 is a left side view.
Figure 4:
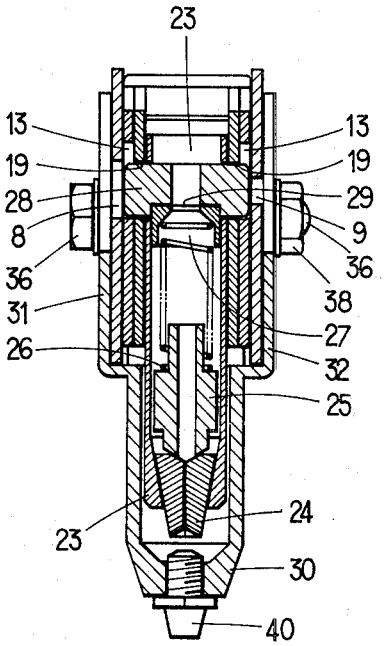
FIG. 4 is a view in section taken along the line A—A in FIG. 1.

The hand riveter of this invention consists essentially of a frame main body, a lever, a jaw case support member, a jaw case having a jaw assembly fitted therein, and a jaw case housing.

The frame main body 1 has a head 4 opened at its upper, lower and front portions to provide opposite side walls 2, 3 which are formed, in opposed relation to each other, with holes 5, 5 for passing therethrough the pivot to be described later and with openings 6, 6 for removably inserting therethrough the locking pin to be described later. The opening 6 is in the form of a slot extending along a circumference centered about the pivot. One of the side walls 2 is formed at upper and lower front two portions with threaded bores 7, 7 and further has a hole 8 for inserting therethrough the jaw case support pin to be described later. The other side plate 3 has a small hole 9 opposed to the hole 8.

The lever 10 has a head opened at its upper, lower and front portions to provide bifurcated opposite side walls 11, 11 which are formed, in opposed relation to each other, with holes 12, 12 for passing the pivot and with slots 13, 13 for permitting the turn of the jaw case support member to be described later. The slots are arranged on the same circumference as the hole 8 in the frame main body 1 to communicate with the hole 8, the circumference being centered about the pivot. Holes 14, 14 for passing the locking pin therethrough are also formed in the side walls and arranged on the same circumference as the openings 6 of the frame main body 1 so as to communicate with the openings 6, the circumference being centered about the pivot.

The jaw case support member 15 comprises two circular side plates 16, 16 spaced apart by a specified distance in opposed relation to each other and partially connected together by a plate 17. In opposed relation to each other, the side plates 16, 16 have holes 18, 18 for the pivot and holes 19, 19 for the jaw case support pin. The latter holes are arranged on a circumference which is centered about the pivot and on which the hole 8 of the frame main body 1 and the slot 13 of the lever 10 are arranged, the holes 19 thus being adapted to communicate with the hole 8 and the slots 13. Each of the side plates 16 further has locking pin bores 20 and 21 at two locations angularly displaced from each other about the pivot by 90 degrees. These pin bores are arranged on the same circumference as the opening 6 of the frame main body 1 and the hole 14 of the lever 10 for communication with the opening 6 and the hole 14. The side plates 16, 16 of the support member 15 further have knobs 22, 22 for turning the support member.

The jaw assembly accommodated in the jaw case 23 comprises jaws 24, a jaw pusher 25, a jaw pusher pressing spring 26 and a spring seat 27. The spring seat 27 is press-fitted in a recess 29 formed in the support pin 28 extending through an upper portion of the case to hold the jaw assembly in position.

The jaw case housing 30 has bifurcated lugs 31, 32 extending from the opposite side portions of its base end. The lugs have at their upper ends slots 33, 33 extending in the same direction as the length of the housing 30. The lug 31 has a hole 34 at a front lower side portion.

The main components described above will be assembled in the following manner.

The jaw case support member 15 is placed between the bifurcated side walls 11, 11 of the lever 10 and turnably supported on the head of the lever by a short tube 35 inserted through the holes 12 and 18.

The jaw case 23 is pivoted to the support member 15 by the support pin 28 having its opposite ends inserted in the holes 19, 19 of the member 15. The projecting ends of the pin 28 are engaged in the slots 13, 13 of the lever 10, whereby the case 23 is supported on the head of the lever 10 and made turnable with the support member 15 within the dimensional range provided by the slots 13.

Figure 5:
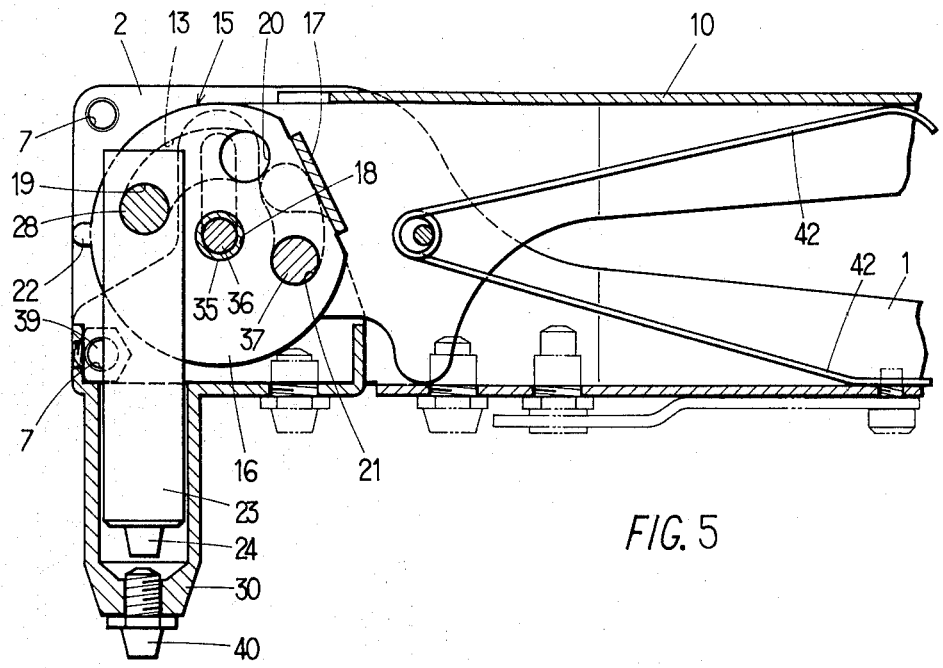
FIG. 5 is a view in section taken along the line B—B in FIG. 3.
Figure 6:
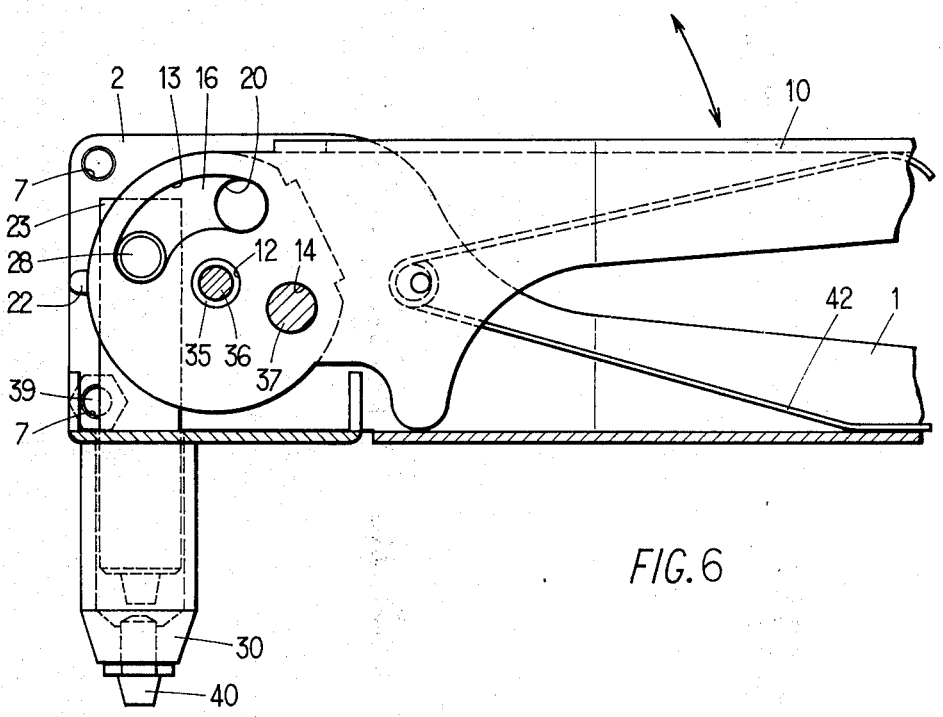
FIG. 6 is a view in section taken along the line C—C in FIG. 3.

The lever 10 thus carrying the jaw case 23 and the jaw case support member 15 has its head positioned between the side walls 2, 3 of the head 4 of the frame main body 1. The pivot 36 in the form of a bolt is inserted through the holes 5, 5 in the side walls and through the short tube 35, whereby the lever 10 is openably pivoted to the frame main body 1. The jaw case support member 15 is locked in a specified position relative to the lever 10 by suitably turning the member 15 to bring either pair of the bores 20 and 21, e.g. the pair of bores 21, into communication with the openings 6 of the frame main body 1 and with the holes 14 of the lever 10, and inserting the locking pin 37 through these bores, openings and holes. In this state, the support pin 28 for the jaw case 23 is positioned at one end of the slot 13 of the lever 10 (i.e. at the left end of the slot 13 in FIG. 5), retaining the jaw case 23 in a vertical position.

In the state described above, the ends of the pivot 36 projecting from the opposite sides of the frame main body 1 are engaged in the slots 33, 33 of the lugs 31, 32 of the jaw case housing 30, whereby the housing 30 is disposed in a vertical position with the jaw case 23 accommodated therein. The housing is properly held in its vertical position as seen in FIGS. 1 to 7 by pulling up the housing 30 along the pivot 36 engaged in the slots 33, tightening a nut 38 on one end of the pivot 36, inserting a bolt 39 through the hole 34 in the lug 31 into the lower threaded bore 7 of the side wall 2 of the frame main body 1, and tightening the bolt 39. In this state, the lugs 31, 32 on the housing 30 cover the openings 6, 6 of the frame main body 1 to prevent the locking pin 37 from slipping off.

The jaw case housing 30 of the hand riveter thus constructed according to the present invention is shiftable from its vertical position to a horizontal position by the procedure to be described below.

In a manner reverse to the foregoing, the bolt 30 is loosened and removed from the holes of the frame main body 1 and the lug 31 on the housing 30. With the nut 38 loosened, the housing 30 is pulled down along the slots 33 to remove the lugs 31, 32 from the openings 6 of the frame main body 1. Subsequently the locking pin 37 is removed, and the jaw case support member 15 is turned in a direction opposite to the previous direction to bring the other pair of bores 30 in the support member 15 into communication with the openings 6 of the frame main body 1 and the holes 14 of the lever 10. The locking pin 37 is thereafter inserted through these bores, openings and holes, whereby the support member 15 is locked to the lever 10 with the jaw case support pin 28 positioned at the other end of the slot 13 of the lever (i.e. at the right end of the slot 13 in FIG. 5), so that the jaw case 23 and the housing 30 therefor can be held in a horizontal position. With the housing 30 then retracted toward the pivot 36, the nut 38 on the end of the pivot 36 is tightened up. The bolt 39 is inserted through the hole 34 in the lug 31 into the upper threaded bore 7 in the side wall 2 of the frame main body 1 and tightened up, whereby the housing 30 is properly held in its horizontal position as seen in FIG. 8.

Further illustrated in the drawings are a nose piece 40 attached to the forward end of the housing 30, interchangeable nose pieces **40*a*, 40*b*, 40*c* having openings of different diameters, a tool 41 for handling the nose pieces, pins, bolts, nuts, etc. and a lever returning spring 42**.

The present invention is not limited to the embodiment described above in detail but can be modified suitably without departing from the scope of the invention. For instance, the opening 6 formed in the frame main body 1 for the locking pin 37 may be in the form of a circular aperture dimensioned to pass the locking pin therethrough. The opening 6 may be formed in only one of the side walls 2, 3.

What is claimed is:

1. A hand riveter comprising a frame main body having a head opened at least at its upper, lower and front portions to provide opposite side walls, a lever turnably supported by a pivot on the side walls, a jaw case support member turnably mounted on the pivot and having a jaw case pivotably supported thereon, and a jaw case housing supported by the pivot upwardly and downwardly turnably, the frame main body being formed in at least one of the side walls with an opening positioned around the pivot for passing therethrough a pin for locking the jaw case support member in an adjustable position, the lever being formed around the pivot with a slot for permitting turn of the jaw case support member and with a hole for passing the locking pin therethrough, the jaw case support member being formed with locking pin bores arranged around the pivot at least at two locations angularly displaced from each other about the pivot approximately by 90 degrees, the jaw case support member being turnably attached to the lever by a jaw case support pin inserted through the slot, the locking pin being removably inserted through the opening in the frame main body, the hole in the lever and either one of the bores in the jaw case support member, the jaw case housing having the jaw case fitted therein and attached to the frame head fixedly but angularly shiftably to a vertical position or a horizontal position.

2. A hand riveter as defined in claim 1 wherein the opening in the frame main body, the hole in the lever and the bores in the jaw case support member for passing the locking pin therethrough are arranged on the same circumference centered about the pivot.

3. A hand riveter as defined in claim 1 wherein the opening of the frame main body is in the form of a slot along a circumference centered about the pivot and is formed in each of the opposite side walls of the frame head.

4. A hand riveter as defined in claim 1 wherein the slot in the lever extends along a circumference centered about the pivot, and the slot and the hole of the lever are formed in each of bifurcated opposed side walls provided at the head of the lever.

5. A hand riveter as defined in claim 1 wherein the jaw case support member comprises opposed side plates partially connected together, and the locking pin bores are formed in each of the side plates.

6. A hand riveter as defined in claim 1 wherein the jaw case housing is provided with bifurcated lugs extending from the opposite sides of its base end and each formed with a slot in an upper end portion thereof, the pivot being engageable in the slots of the lugs at its opposite projecting ends so that the housing can be releasably fastened to the frame main body by a fastening member, the lug being adapted to cover the opening of the frame main body.

7. A hand riveter as defined in claim 1 wherein the housing is angularly shiftably fixed to the frame main body by a threaded bore formed in at least one of the side walls of the frame main body and arranged on the same circumference centered about the pivot, a hole formed in at least one side of the housing and positioned in corresponding relation to the threaded bore, and a bolt therein.

* * * * *